US010883289B2

(12) United States Patent
Lin et al.

(10) Patent No.: US 10,883,289 B2
(45) Date of Patent: Jan. 5, 2021

(54) AUTOMATIC PARKING SYSTEM AND PARKING AND UNPARKING METHOD THEREOF

(71) Applicant: Guangdong Weichuang Wuyang Intelligent Equipment Co., Ltd., Dongguan (CN)

(72) Inventors: Weitong Lin, Dongguan (CN); Yungao Hu, Dongguan (CN); Yongjin Guo, Dongguan (CN); Pin Cao, Dongguan (CN)

(73) Assignee: GUANGDONG WEICHUANG WUYANG INTELLIGENT EQUIPMENT CO., LTD., Dongguan (CN)

( * ) Notice: Subject to any disclaimer, the term of this patent is extended or adjusted under 35 U.S.C. 154(b) by 223 days.

(21) Appl. No.: 16/165,845

(22) Filed: Oct. 19, 2018

(65) Prior Publication Data

US 2019/0055747 A1 Feb. 21, 2019

(30) Foreign Application Priority Data

Feb. 1, 2018 (CN) ..... 2018 1 0102295

(51) Int. Cl.
*E04H 6/22* (2006.01)

(52) U.S. Cl.
CPC ..... *E04H 6/22* (2013.01); *E04H 6/225* (2013.01)

(58) Field of Classification Search
CPC ..... E04H 6/22; E04H 6/225
See application file for complete search history.

(56) References Cited

U.S. PATENT DOCUMENTS 2,412,009 A * 12/1946 Rickland ..... E04H 6/225 414/239
3,395,815 A * 8/1968 Johnson ..... E04H 6/22 414/232
3,618,793 A * 11/1971 Coursey ..... E04H 6/422 414/233
5,314,284 A * 5/1994 Tsai ..... E04H 6/282 414/227
5,314,285 A * 5/1994 Lai ..... E04H 6/22 414/236
5,868,540 A * 2/1999 Hirose ..... E04H 6/282 414/234

(Continued)

*Primary Examiner* — Mark C Hageman
(74) *Attorney, Agent, or Firm* — Shimokaji IP

(57) ABSTRACT

The present invention discloses an automatic parking system including an in-out space, a plurality of parking spaces arranged at multiple parking levels, a pickup machine, and a lifting tunnel with a lifting device disposed therein. The pickup machine includes a frame which includes a first frame and a second frame, a first pickup device and a second pickup device. The first pickup device is configured to move a loading board onto the first frame or out from the first frame. The second pickup device is configured to move the loading board onto the second frame or out from the second frame. The lifting device is configured to convey the pickup machine up and down in the lifting tunnel. The present invention also discloses a parking and unparking method of the automatic parking system. The parking and unparking efficiency of the automatic parking system of the present invention is greatly improved.

9 Claims, 7 Drawing Sheets

(56) References Cited

U.S. PATENT DOCUMENTS

| | | | | |
|---|---|---|---|---|
| 6,168,365 | B1 * | 1/2001 | Lee | E04H 6/225 414/253 |
| 8,033,773 | B2 * | 10/2011 | Zangerle | E04H 6/225 414/258 |
| 2003/0035707 | A1 * | 2/2003 | Volpe | E04H 6/287 414/254 |
| 2005/0074314 | A1 * | 4/2005 | Hart | E04H 6/225 414/234 |
| 2009/0081011 | A1 * | 3/2009 | Kaufmann | E04H 6/225 414/229 |
| 2011/0123302 | A1 * | 5/2011 | Zangerle | E04H 6/225 414/239 |

* cited by examiner

4

AUTOMATIC PARKING SYSTEM AND PARKING AND UNPARKING METHOD THEREOF

CROSS-REFERENCE TO RELATED APPLICATIONS

This application claims the benefit of priority to Chinese patent application No. 201810102295.1, filed on Feb. 1, 2018, which is hereby incorporated by reference in its entirety.

FIELD OF THE INVENTION

The present invention relates to a parking equipment, and more particularly to an automatic parking system and a parking and unparking method thereof.

BACKGROUND OF THE INVENTION

At present, an automatic parking system with loading boards generally suffers from slow parking and unparking speed. The main reason is that the automatic parking system with loading boards generally needs to get and store the loading board twice, whether when parking or when unparking. When parking, a lifting device of the automatic parking system needs to move a pickup machine to a corresponding height for getting one loading board without load, if an in-out space of the automatic parking system have not one loading board without load therein. Then the pickup machine with the loading board without load is moved to the height corresponding to the in-out space by the lifting device and then moves the loading board without load to access the in-out space. When a vehicle is parked on the loading board in the in-out space, the pickup machine gets the loading board with the vehicle thereon from the in-out space and then is moved to a corresponding height by the lifting device for parking the vehicle. When unparking, if the in-out space has a loading board without load therein, the lifting device needs to move the pickup machine to the height corresponding to the in-out space for getting the loading board without load from the in-out space. Then the lifting device moves the pickup machine to a corresponding height for storing the loading board without load to an empty parking space. Then the lifting device moves the pickup machine to the height corresponding to the vehicle ready to be unparked for getting the loading board with the vehicle thereon from a corresponding parking space. Then the lifting device moves the pickup machine to the height corresponding to the in-out space for moving the loading board with the vehicle thereon to access the in-out space. Therefore, no matter when parking or when unparking, the lifting device generally needs to move up and down twice, the pickup machine needs to get and store the loading board twice, which makes the automatic parking system have a slower parking and unparking speed and then causes waste of time.

Therefore, it is necessary to provide an automatic parking system which can improve the parking and unparking speed and save the time.

SUMMARY OF THE INVENTION

A first objective of the present invention is to provide an automatic parking system, which can reduce the time of the up-down movement of a lifting device thereof and the waiting time of getting and storing the loading board so as to improve the parking and unparking speed and save the time.

A second objective of the present invention is to provide a parking and unparking method of the automatic parking system, which can reduce the time of the up-down movement of the lifting device and the waiting time of getting and storing the loading board so as to improve the parking and unparking speed and save the time.

To achieve the above-mentioned first objective, an automatic parking system includes an in-out space, a plurality of parking spaces arranged at multiple parking levels, a pickup machine, and a lifting tunnel with a lifting device disposed therein. The pickup machine includes a frame which includes a first frame and a second frame, a first pickup device and a second pickup device. The first pickup device is configured to move a loading board onto the first frame or out from the first frame. The second pickup device is configured to move the loading board onto the second frame or out from the second frame. The lifting device is configured to convey the pickup machine up and down in the lifting tunnel.

Preferably, a bottom of the loading board forms a friction board extending along a moving direction of the loading board, at least one of the first pickup device and the second pickup device includes a movable mounting body disposed in the first frame or the second frame and movable along a longitudinal direction thereof, a pair of friction wheels disposed in a longitudinal outside of the movable mounting body and capable of approaching to or departing from each other, a friction driving mechanism for driving the two friction wheels rotate in opposite directions so as to move the friction board clamped in the two friction wheels, and a micro-motion mechanism for driving the movable mounting body move along the longitudinal direction of the movable mounting body so as to move the friction board into or away from between the two friction wheels.

Preferably, the friction driving mechanism includes a chainwheel transmission assembly disposed in the movable mounting body and a first driving motor for driving the chainwheel transmission assembly, the chainwheel transmission assembly includes two driven chainwheels coaxial with the respective friction wheels, a driving chainwheel connected with an output end of the first driving motor, and a chain disposed on the driving chainwheel and the two driven chainwheels.

Preferably, the micro-motion mechanism includes a second driving motor, a driving gear connected with an output end of the second driving motor, and a rack extending along a moving direction of the movable mounting body and engaging with the driving gear, the rack is connected with the movable mounting body for driving the movable mounting body.

Preferably, the frame further includes guiding beams mounted on two transverse sides of at least one of the first frame and the second frame, each guide beam has multiple vertical guiding wheels and multiple horizontal guiding wheels disposed therein, two transverse side surfaces of the movable mounting body contact with the corresponding vertical guiding wheels, two transverse sides of the movable mounting body are disposed on the corresponding horizontal guiding wheels.

Preferably, the frame further includes a connecting structure connecting the first frame and the second frame, the pickup machine further includes two transverse moving devices disposed at two longitudinal sides of the frame, the lifting device includes a lifting tray with transverse tracks and a lifting driving assembly for driving the lifting tray move vertically, and the pickup machine is capable of being driven to move along the transverse tracks by the transverse moving device.

Preferably, the transverse moving device includes a third driving motor, a driving wheel assembly, a driven wheel assembly and a transverse connecting rod, an output end of the third driving motor is connected with the driving wheel assembly, the driving wheel assembly and the driven wheel assembly are mounted on two ends of the transverse connecting rod, the rotation of the driving wheel assembly is transmitted to the driven wheel assembly by the transverse connecting rod.

Preferably, the second frame is under the first frame and is configured to place the loading board without load.

To achieve the above-mentioned second objective, a parking and unparking method of the automatic parking system includes: move the loading board with a vehicle thereon in the in-out space to access the first frame; move the second frame to a height corresponding to the in-out space; move the loading board without load on the second frame to access the in-out space; move the loading board with the vehicle thereon to a height corresponding to the corresponding parking space; move the loading board with the vehicle thereon to access the corresponding parking space; move the loading board without load in the in-out space to access one of the first frame and the second frame, once receiving an unparking order; move the other of the first frame and the second frame to the height corresponding to the corresponding parking space; move the loading board with the vehicle thereon in the corresponding parking space to access the other of the first frame and the second frame; move the loading board with the vehicle thereon to the height corresponding to the in-out space; and moving the loading board with the vehicle thereon to access the in-out space.

In comparison with the prior art, the automatic parking system of the present invention includes the first frame, the second frame, the first pickup device and the second pickup device. When parking, the first frame is configured to place the loading board with the vehicle thereon got from the in-out space, then the loading board without load placed on the second frame is moved into the in-out space, which saves the time for getting the loading board without load from a parking space, so the parking time of the automatic parking system is greatly reduced. When unparking, the loading board without load placed in the in-out space is moved onto one of the first frame and the second frame, then the other of the first frame and the second frame is moved to the height corresponding to the corresponding parking space so as to get the loading board with the vehicle thereon from the corresponding parking space, which saves the time for storing the loading board without load, so the unparking time of the automatic parking system is greatly reduced. Therefore, the parking and unparking efficiency of the automatic parking system of the present invention is greatly improved. In addition, the second frame is under the first frame and is configured to place the loading board without load, thus the distance between the first frame and the second frame can be very small, the pickup machine has a substantially same occupied space as the previous pickup machine and then has a stable and reliable overall structure.

BRIEF DESCRIPTION OF THE DRAWINGS

The accompanying drawings facilitate an understanding of the various embodiments of this invention. In such drawings.

DETAILED DESCRIPTION OF ILLUSTRATED EMBODIMENTS

Figure 1:
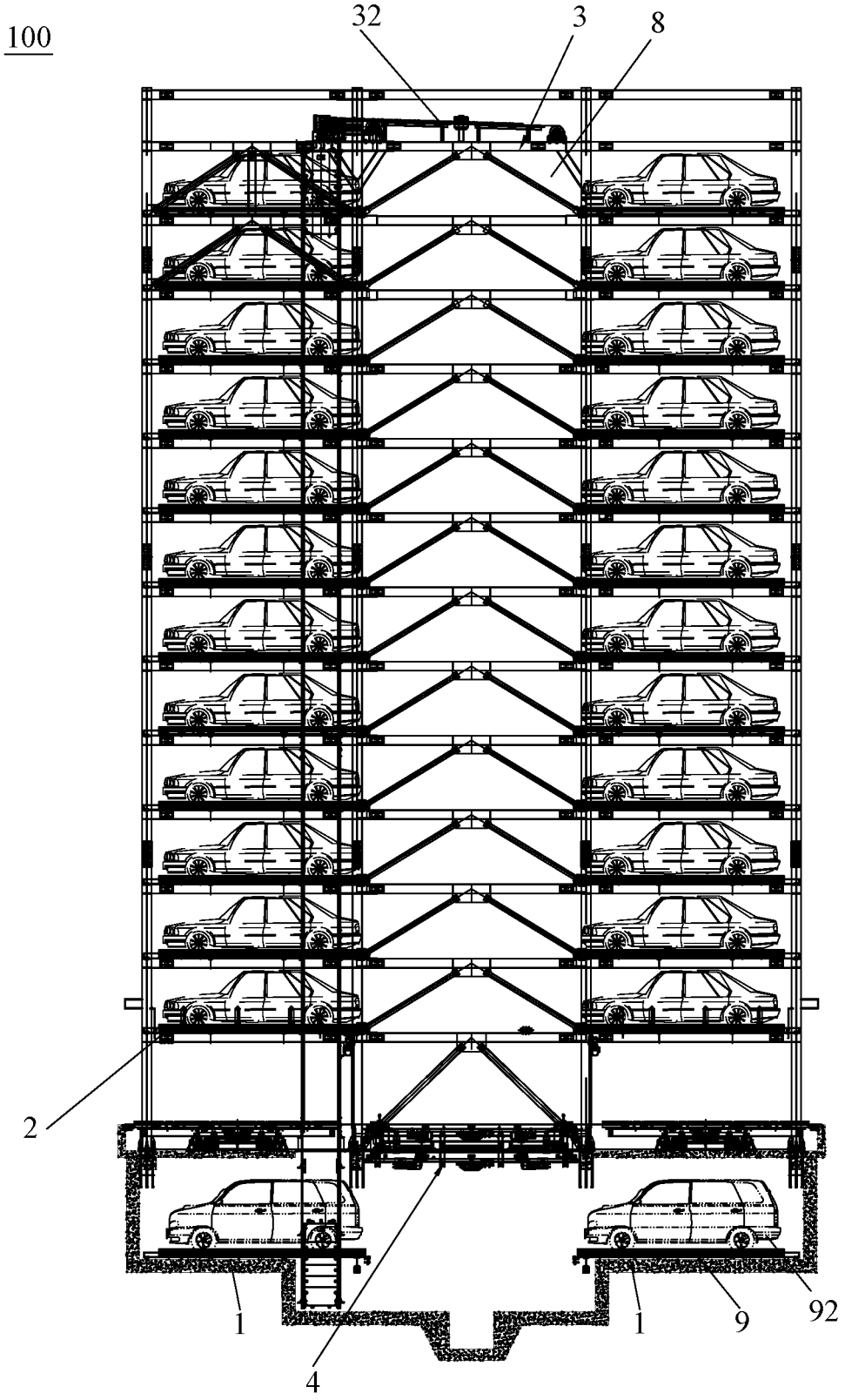
FIG. 1 is a front view of an automatic parking system according to an embodiment of the present invention.
Figure 2:
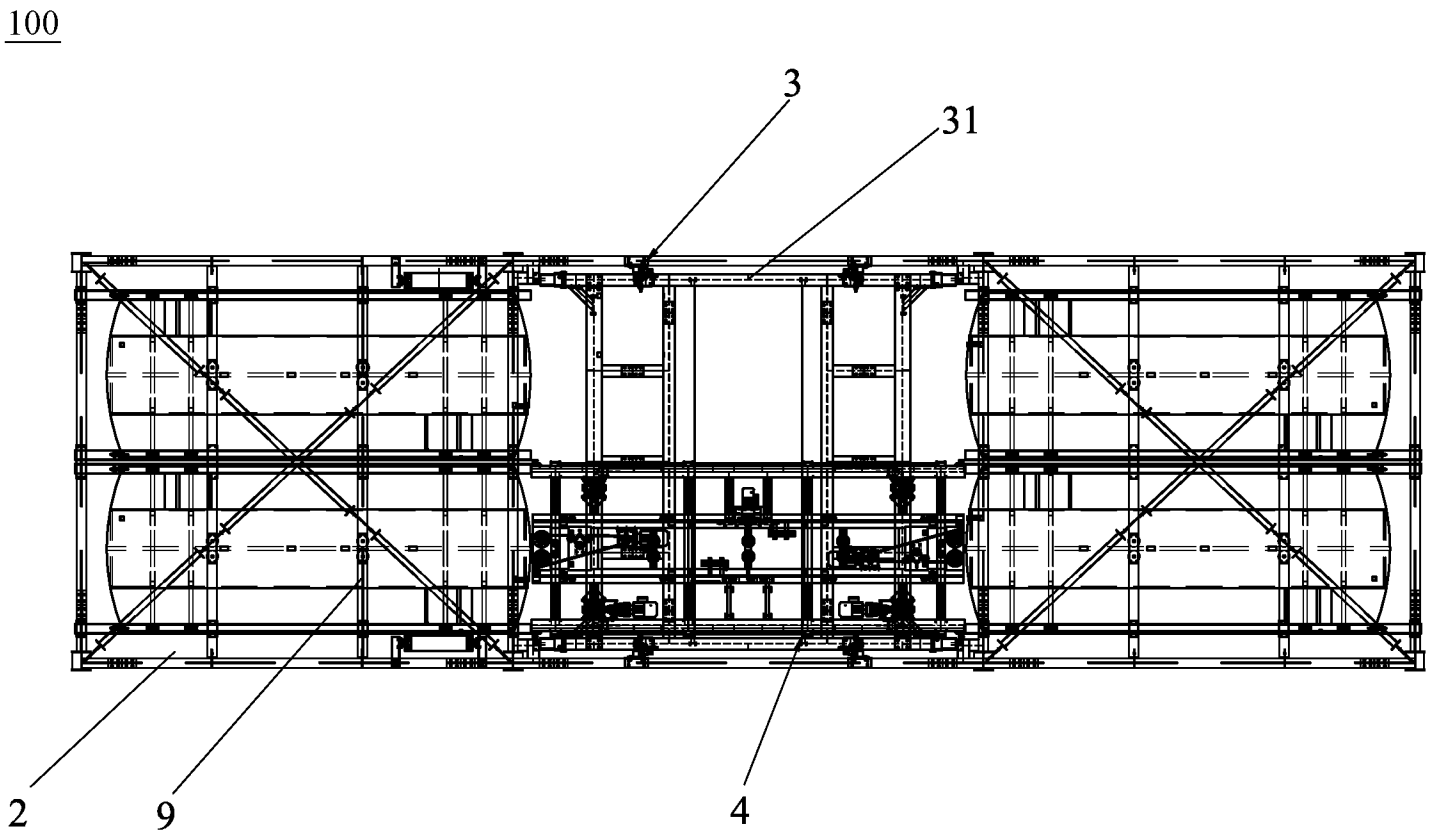
FIG. 2 is a top plan view of the automatic parking system in FIG. 1.

A distinct and full description of the technical solution of the present invention will follow by combining with the accompanying drawings.

Referring to FIGS. 1-7, an automatic parking system 100 according to an embodiment of the present invention includes an in-out space 1, a plurality of parking spaces 2 arranged at multiple parking levels, a pickup machine 4, and a lifting tunnel 8 with a lifting device 3 disposed therein. The pickup machine 4 includes a frame 41 which includes a first frame 411 and a second frame 412, a first pickup device 5 and a second pickup device 6. The first pickup device 5 is configured to move a loading board 9 onto the first frame 411 or out from the first frame 411. The second pickup device 6 is configured to move the loading board 9 onto the second frame 412 or out from the second frame 412. The lifting device 3 is configured to convey the pickup machine 4 up and down in the lifting tunnel 8.

As shown in FIGS. 1-5, in this embodiment, a bottom of the loading board 9 forms a friction board 91 extending along a moving direction of the loading board 9, each of the first pickup device 5 and the second pickup device 6 includes a movable mounting body 51 disposed in the first frame 411 or the second frame 412 and movable along a longitudinal direction thereof, a pair of friction wheels 52 disposed in a longitudinal outside of the movable mounting body 51 and capable of approaching to or departing from each other, a friction driving mechanism 53 for driving the two friction wheels 52 rotate in opposite directions so as to move the friction board 91 clamped in the two friction wheels 52, and a micro-motion mechanism 54 for driving the movable mounting body 51 move along the longitudinal direction of the movable mounting body 51 so as to move the friction board 91 into or away from between the two friction wheels 52.

It should be noted, in this embodiment, both the first pickup device 5 and the second pickup device 6 move the loading board 9 by way of the movable mounting body 51 moving to the bottom of the loading board 9 and then the friction wheels 52 engaging with the friction board 91, which should not be a limitation to the present invention. For example, the first pickup device 5 and the second pickup device 6 may be different forms and may move the loading board 9 by other ways.

Preferably, in this embodiment, in order to adapt to the automatic parking system 100 with parking spaces 2 at two opposite sides of the pickup machine 4, each of the first pickup device 5 and the second pickup device 6 has two pair of friction wheels 52 disposed in two longitudinal outsides of the corresponding movable mounting body 51, and two friction driving mechanisms 53 for driving the two pair of friction wheels 52.

Figure 6:
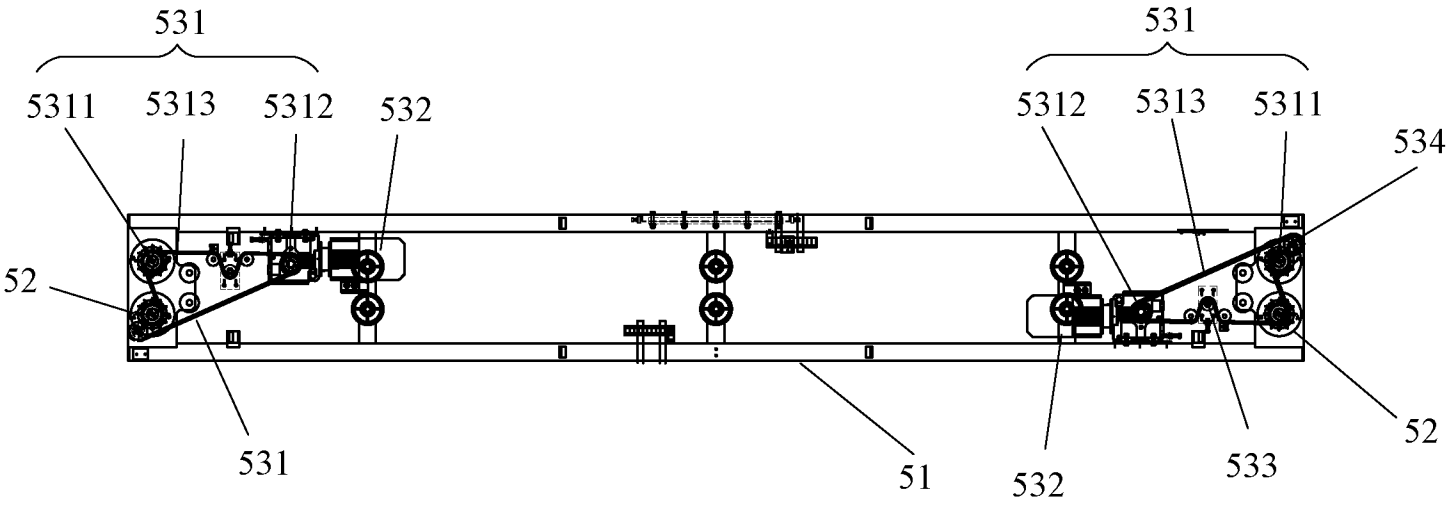
FIG. 6 is an enlarged view of a circled portion A shown in FIG. 3.

Referring to FIG. 6, the friction driving mechanism 53 includes a chainwheel transmission assembly 531 disposed in the movable mounting body 51 and a first driving motor 532 for driving the chainwheel transmission assembly 531, the chainwheel transmission assembly 531 includes two driven chainwheels 5311 coaxial with the respective friction wheels 52, a driving chainwheel 5312 connected with an output end of the first driving motor 532, and a chain 5313 disposed on the driving chainwheel 5312 and the two driven chainwheels 5311.

In this embodiment, the friction driving mechanism 53 further includes a tensioning assembly 533 disposed in the transmission route of the chain 5313 for tensioning the chain 5313 and a redirection chainwheel 534 disposed in the transmission route of the chain 5313 and adjacent to one of the driven chainwheels 5311. Because the tensioning assembly 533 can adjust the tensioning degree of the chain 5313, the chain 5313 and the chainwheels can run more stably.

Figure 7:
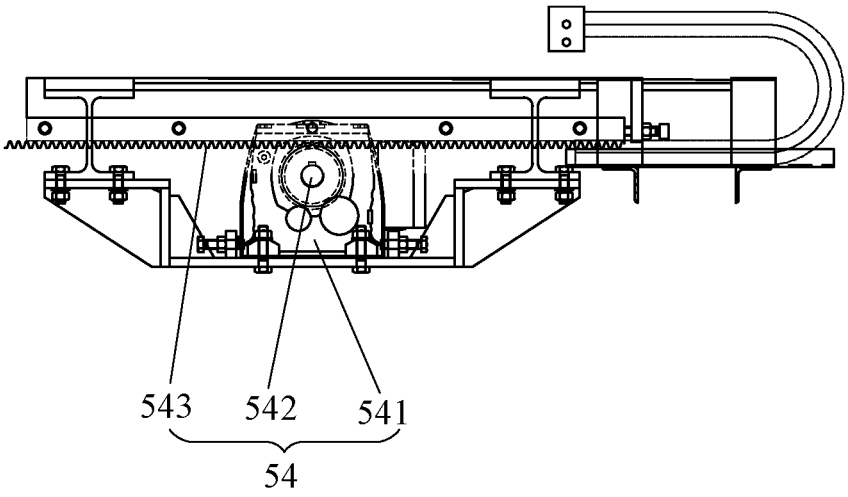
FIG. 7 is an enlarged view of a partial structure of a circled portion B shown in FIG. 4.

Referring to FIG. 7, specifically, the micro-motion mechanism 54 includes a second driving motor 541, a driving gear 542 connected with an output end of the second driving motor 541, and a rack 543 extending along a moving direction of the movable mounting body 51 and engaging with the driving gear 542, the rack 543 is connected with the movable mounting body 51 for driving the movable mounting body 51.

Figure 3:
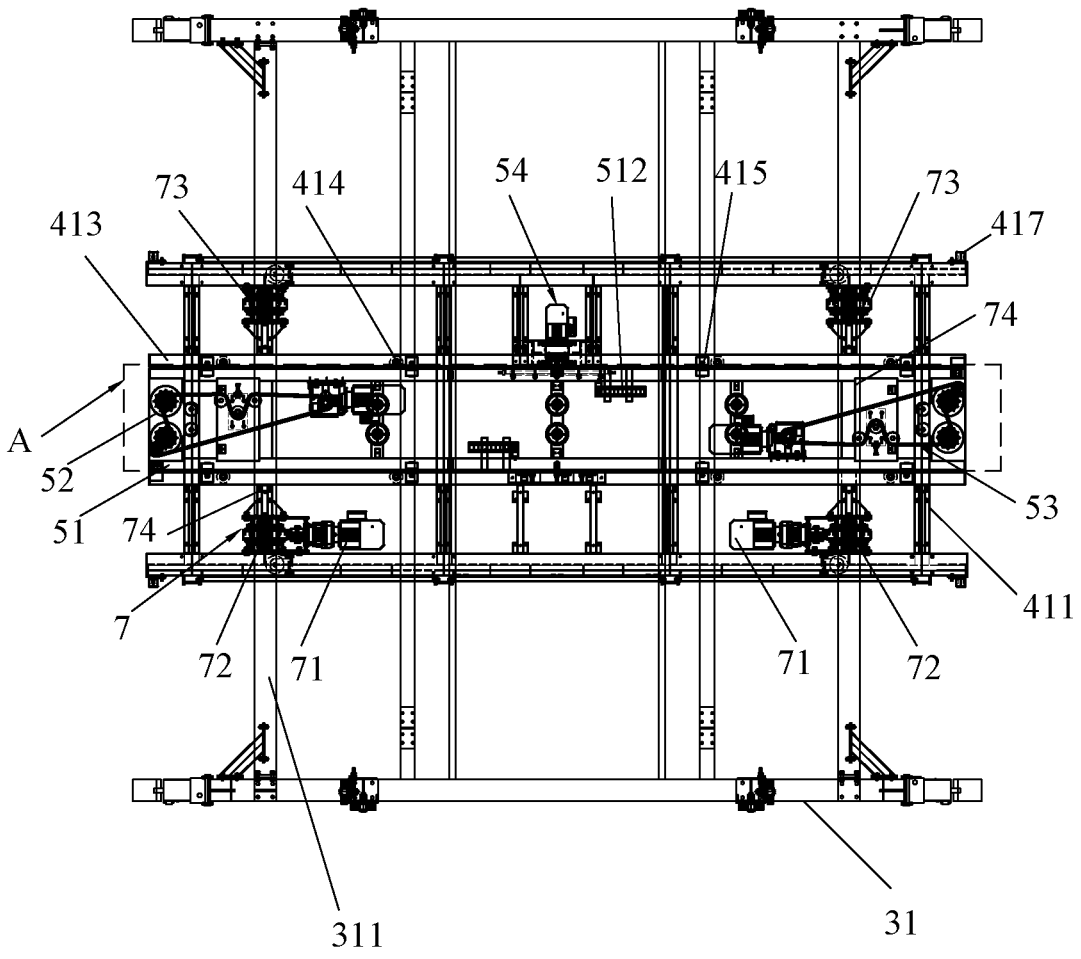
FIG. 3 is a top plan view of a pickup machine and a lifting tray of the automatic parking system in FIG. 2.
Figure 4:
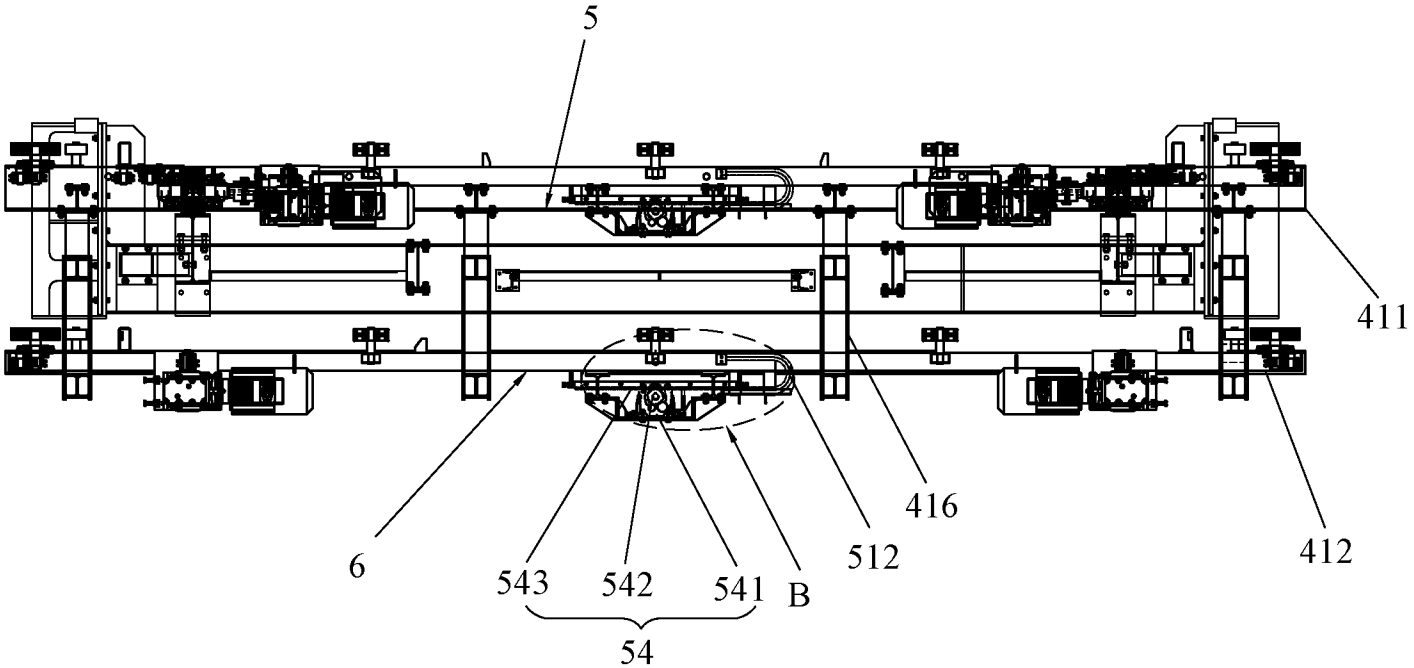
FIG. 4 is a front view of the pickup machine shown in FIG. 3.
Figure 5:
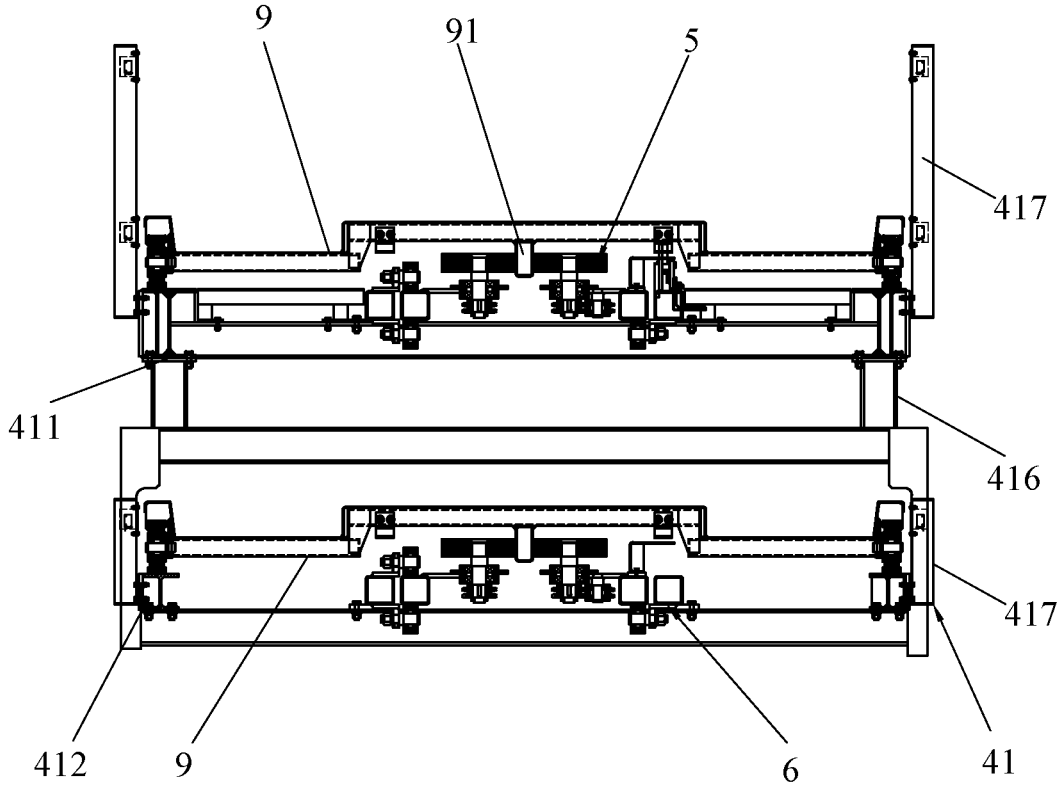
FIG. 5 is a side view of the pickup machine shown in FIG. 4, with loading boards placed thereon.

Referring to FIG. 3, specifically, the frame 41 further includes guiding beams 413 mounted on two transverse sides of at least one of the first frame 411 and the second frame 412, each guide beam 413 has multiple vertical guiding wheels 414 and multiple horizontal guiding wheels 415 disposed therein, two transverse side surfaces of the movable mounting body 51 contact with the corresponding vertical guiding wheels 414, two transverse sides of the movable mounting body 51 are disposed on the corresponding horizontal guiding wheels 415. Therefore, the movable mounting body 51 can move more smoothly, and the vertical guiding wheels 414 can prevent the pickup machine 4 from shaking during the movement, then the pickup machine 4 can move more stably.

More specifically, the frame 41 further includes a connecting structure 416 connecting the first frame 411 and the second frame 412 so as to achieve a linkage of the first frame 411 and the second frame 412. In this embodiment, a positioning mechanism 417 disposed in the frame 41 for positioning the loading board 9. Specifically, two positioning mechanisms 417 are disposed in four corners of the frame 41.

Referring to FIG. 3, the pickup machine 4 further includes two transverse moving devices 7 disposed at two longitudinal sides of the frame 41, the lifting device 3 includes a lifting tray 31 with transverse tracks 311 and a lifting driving assembly 32 for driving the lifting tray 31 move vertically, and the pickup machine 4 is capable of being driven to move along the transverse tracks 311 by the transverse moving device 7 so as to correspond with different parking spaces 2. In order to make the pickup machine 4 can move more stably in the lifting tray 31, in this embodiment, two transverse moving devices 7 are disposed in two longitudinal sides of the second frame 412, respectively, which should not be a limitation.

Specifically, the transverse moving device 7 includes a third driving motor 71, a driving wheel assembly 72, a driven wheel assembly 73 and a transverse connecting rod 74, an output end of the third driving motor 71 is connected with the driving wheel assembly 72, the driving wheel assembly 72 and the driven wheel assembly 73 are mounted on two ends of the transverse connecting rod 74, the rotation of the driving wheel assembly 72 is transmitted to the driven wheel assembly 73 by the transverse connecting rod 74.

In this embodiment, the third driving motor 71 is disposed in the first frame 411 for reducing the size of the pickup machine 4, which should not be a limitation.

In this embodiment, the second frame 412 is under the first frame 411 and is configured to place the loading board 9 without load, the first frame 411 is configured to place the loading board 9 with the vehicle 92 thereon. Because the second frame 412 under the first frame 411 is configured to place the loading board 9 without load, the distance between the first frame 411 and the second frame 412 can be very small, thus the pickup machine 4 has a substantially same occupied space as the previous pickup machine and then has a stable and reliable overall structure.

In this embodiment, the automatic parking system 100 includes two in-out spaces 1, each of the in-out spaces 1 disposes a rotating tray 11 therein for moving the vehicle 92 into or out from the automatic parking system 100. The rotating tray 11 can rotate the vehicle 92 90 degrees, which should not be a limitation.

The present invention further provides a parking and unparking method, which includes: (1) move the loading board 9 with the vehicle 92 thereon in the in-out space 1 to access the first frame 411; (2) move the second frame 412 to a height corresponding to the in-out space 1 by the lifting device 3; (3) move the loading board 9 without load on the second frame 412 to access the in-out space 1; (4) move the loading board 9 with the vehicle 92 thereon to a height corresponding to the corresponding parking space 2 by the lifting device 3; (5) move the loading board 9 with the vehicle 92 thereon to access the corresponding parking space 2; (6) move the loading board 9 without load in the in-out space 1 to access one of the first frame 411 and the second frame 412, once receiving an unparking order; (7) move the other of the first frame 411 and the second frame 412 to the height corresponding to the corresponding parking space 2; (8) move the loading board 9 with the vehicle 92 thereon in the corresponding parking space 2 to access the other of the first frame 411 and the second frame 412; (9) move the loading board 9 with the vehicle 92 thereon to the height corresponding to the in-out space 1; (10) moving the loading board 9 with the vehicle 92 thereon to access the in-out space 1.

Before steps (1) and (5), if the first frame 411 is not at the same height with the in-out space 1, the lifting device 3 moves the first frame 411 to the same height with the in-out space 1.

Preferably, the second frame 412 is under the first frame 411 and is configured to place the loading board 9 without load, the first frame 411 is configured to place the loading board 9 with the vehicle 92 thereon.

In comparison with the prior art, the automatic parking system 100 of the present invention includes the first frame 411, the second frame 412, the first pickup device 5 and the second pickup device 6. When parking, the first frame 411 is configured to place the loading board 9 with the vehicle 92 thereon got from the in-out space 1, the loading board 9 without load placed on the second frame 412 is moved into the in-out space 1, which saves the time for getting the loading board 9 without load from a parking space 2, so the parking time of the automatic parking system 100 is greatly reduced. When unparking, the loading board 9 without load placed in the in-out space 1 is moved onto one of the first frame 411 and the second frame 412, then the other of the first frame 411 and the second frame 412 is moved to the height corresponding to the corresponding parking space 2 so as to get the loading board 9 with the vehicle 92 thereon from the corresponding parking space 2, which saves the time for storing the loading board 9 without load, so the unparking time of the automatic parking system 100 is greatly reduced. Therefore, the parking and unparking efficiency of the automatic parking system 100 of the present invention is greatly improved. In addition, the second frame 412 is under the first frame 411 is configured to place the loading board 9 without load, then the distance between the first frame 411 and the second frame 412 can be very small, the pickup machine 4 has a substantially same occupied space as the previous pickup machine and then has a stable and reliable overall structure.

While the invention has been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention.

What is claimed is:

1. An automatic parking system, comprising:

an in-out space;

a plurality of parking spaces arranged at multiple parking levels;

a pickup machine, the pickup machine comprising a frame which comprises a first frame and a second frame at different heights, a first pickup device and a second pickup device, the first pickup device being configured to move a loading board onto the first frame or out from the first frame, the second pickup device being configured to move the loading board onto the second frame or out from the second frame; and a lifting tunnel with a lifting device disposed therein for conveying the pickup machine up and down;

wherein a bottom of the loading board forms a friction board extending along a moving direction of the loading board, at least one of the first pickup device and the second pickup device comprises a movable mounting body disposed in the first frame or the second frame and movable along a longitudinal direction thereof, a pair of friction wheels disposed in a longitudinal outer side of the movable mounting body and capable of approaching to or departing from each other, a friction driving mechanism for driving the two friction wheels to rotate in opposite directions so as to move the friction board clamped in the two friction wheels, and a micro-motion mechanism for driving the movable mounting body to move along the longitudinal direction of the movable mounting body so as to move the friction board into or away from between the two friction wheels;

wherein the micro-motion mechanism comprises a second driving motor, a driving gear connected with an output end of the second driving motor, and a rack extending along a moving direction of the movable mounting body and engaging with the driving gear, the rack is connected with the movable mounting body for driving the movable mounting body.

2. The automatic parking system according to claim 1, wherein the friction driving mechanism comprises a chainwheel transmission assembly disposed in the movable mounting body and a first driving motor for driving the chainwheel transmission assembly, the chainwheel transmission assembly comprises two driven chainwheels coaxial with the respective friction wheels, a driving chainwheel connected with an output end of the first driving motor, and a chain disposed on the driving chainwheel and the two driven chainwheels.

3. The automatic parking system according to claim 1, wherein the frame further comprises guiding beams mounted on two transverse sides of at least one of the first frame and the second frame, each guiding beam has multiple vertical guiding wheels and multiple horizontal guiding wheels disposed therein, two transverse side surfaces of the movable mounting body contact with the corresponding vertical guiding wheels, two transverse sides of the movable mounting body are disposed on the corresponding horizontal guiding wheels.

4. The automatic parking system according to claim 1, wherein the frame further comprises a connecting structure connecting the first frame and the second frame, the pickup machine further comprises two transverse moving devices disposed at two longitudinal sides of the frame, the lifting device comprises a lifting tray with transverse tracks and a lifting driving assembly for driving the lifting tray to move vertically, and the pickup machine is capable of being driven to move along the transverse tracks by the transverse moving device.

5. The automatic parking system according to claim 4, wherein the transverse moving device comprises a third driving motor, a driving wheel assembly, a driven wheel assembly and a transverse connecting rod, an output end of the third driving motor is connected with the driving wheel assembly, the driving wheel assembly and the driven wheel assembly are mounted on two ends of the transverse connecting rod, the rotation of the driving wheel assembly is transmitted to the driven wheel assembly by the transverse connecting rod.

6. The automatic parking system according to claim 1, wherein the second frame is under the first frame and is configured to place the loading board without load.

7. A parking and unparking method, comprising:

providing the automatic parking system according to claim 1;

moving the loading board with a vehicle thereon in the in-out space to access the first frame;

moving the second frame to a height corresponding to the in-out space;

moving the loading board without load on the second frame to access the in-out space;

moving the loading board with the vehicle thereon to a height corresponding to the corresponding parking space;

moving the loading board with the vehicle thereon to access the corresponding parking space;

moving the loading board without load in the in-out space to access one of the first frame and the second frame, once receiving an unparking order;

moving the other of the first frame and the second frame to the height corresponding to the corresponding parking space;

moving the loading board with the vehicle thereon in the corresponding parking space to access the other of the first frame and the second frame;

moving the loading board with the vehicle thereon to the height corresponding to the in-out space; and moving the loading board with the vehicle thereon to access the in-out space.

8. An automatic parking system, comprising:

an in-out space;

a plurality of parking spaces arranged at multiple parking levels;

a pickup machine, the pickup machine comprising a frame which comprises a first frame and a second frame at different heights, a first pickup device and a second pickup device, the first pickup device being configured to move a loading board onto the first frame or out from the first frame, the second pickup device being configured to move the loading board onto the second frame or out from the second frame; and a lifting tunnel with a lifting device disposed therein for conveying the pickup machine up and down;

wherein a bottom of the loading board forms a friction board extending along a moving direction of the loading board, at least one of the first pickup device and the second pickup device comprises a movable mounting body disposed in the first frame or the second frame and movable along a longitudinal direction thereof, a pair of friction wheels disposed in a longitudinal outer side of the movable mounting body and capable of approaching to or departing from each other, a friction driving mechanism for driving the two friction wheels to rotate in opposite directions so as to move the friction board clamped in the two friction wheels, and a micro-motion mechanism for driving the movable mounting body to move along the longitudinal direction of the movable mounting body so as to move the friction board into or away from between the two friction wheels;

wherein the frame further comprises guiding beams mounted on two transverse sides of at least one of the first frame and the second frame, each guide beam has multiple vertical guiding wheels and multiple horizontal guiding wheels disposed therein, two transverse side surfaces of the movable mounting body contact with the corresponding vertical guiding wheels, two transverse sides of the movable mounting body are disposed on the corresponding horizontal guiding wheels.

9. An automatic parking system, comprising:

an in-out space;

a plurality of parking spaces arranged at multiple parking levels;

a pickup machine, the pickup machine comprising a frame which comprises a first frame and a second frame at different heights, a first pickup device and a second pickup device, the first pickup device being configured to move a loading board onto the first frame or out from the first frame, the second pickup device being configured to move the loading board onto the second frame or out from the second frame; and a lifting tunnel with a lifting device disposed therein for conveying the pickup machine up and down;

wherein the frame further comprises a connecting structure connecting the first frame and the second frame, the pickup machine further comprises two transverse moving devices disposed at two longitudinal sides of the frame, the lifting device comprises a lifting tray with transverse tracks and a lifting driving assembly for driving the lifting tray move vertically, and the pickup machine is capable of being driven to move along the transverse tracks by the transverse moving device;

wherein the transverse moving device comprises a third driving motor, a driving wheel assembly, a driven wheel assembly and a transverse connecting rod, an output end of the third driving motor is connected with the driving wheel assembly, the driving wheel assembly and the driven wheel assembly are mounted on two ends of the transverse connecting rod, the rotation of the driving wheel assembly is transmitted to the driven wheel assembly by the transverse connecting rod.

* * * * *